US008141565B2

(12) United States Patent
Slavin

(10) Patent No.: US 8,141,565 B2
(45) Date of Patent: Mar. 27, 2012

(54) LOTION, SOAP OR CREAM APPLICATOR OR APPLIANCE

(76) Inventor: Kate R. Slavin, New York, NY (US)

( * ) Notice: Subject to any disclaimer, the term of this patent is extended or adjusted under 35 U.S.C. 154(b) by 81 days.

(21) Appl. No.: 12/710,435

(22) Filed: Feb. 23, 2010

(65) Prior Publication Data

US 2011/0203607 A1 Aug. 25, 2011

(51) Int. Cl.
*A45D 40/26* (2006.01)

(52) U.S. Cl. ..... 132/320

(58) Field of Classification Search ..... 132/313, 132/317, 320; 15/104.94, 144.1, 185, 144.3; 16/429
See application file for complete search history.

(56) References Cited

U.S. PATENT DOCUMENTS

| | | | | |
|---|---|---|---|---|
| 3,009,235 | A * | 11/1961 | De Mestral | 428/86 |
| 3,192,589 | A * | 7/1965 | Pearson | 24/452 |
| 4,464,807 | A * | 8/1984 | Weiss | 15/119.2 |
| 4,941,226 | A * | 7/1990 | Kemper | 15/185 |
| 5,671,497 | A | 9/1997 | Abdo | 15/141.1 |
| D387,480 | S | 12/1997 | Esraelian | D28/7 |
| 5,692,261 | A | 12/1997 | Lops | 15/209.1 |
| D408,944 | S | 4/1999 | Petschow | D28/7 |
| 6,026,535 | A * | 2/2000 | Lankowski | 15/209.1 |
| 6,261,014 | B1 * | 7/2001 | Altobellis et al. | 401/6 |
| D447,279 | S | 8/2001 | Altobellis et al. | D28/7 |
| D473,343 | S | 4/2003 | Carruba et al. | D28/63 |
| D487,164 | S | 2/2004 | Denton | D28/7 |
| D490,614 | S | 6/2004 | Katz et al. | D4/127 |
| D503,828 | S | 4/2005 | Hodge | D28/7 |
| D506,028 | S | 6/2005 | Dickey | D28/7 |
| D511,021 | S | 10/2005 | Angeletta | D28/7 |
| 7,003,849 | B2 * | 2/2006 | Cohen et al. | 16/232 |
| D518,597 | S | 4/2006 | Sommers | D28/7 |
| D552,792 | S | 10/2007 | Bargiel et al. | D28/7 |
| D572,407 | S * | 7/2008 | Cook et al. | D28/7 |
| D587,844 | S | 3/2009 | Slavin et al. | D28/7 |
| 2003/0150078 | A1 * | 8/2003 | Lottie et al. | 15/244.1 |
| 2003/0224138 | A1 * | 12/2003 | Hammer | 428/95 |
| 2005/0204498 | A1 * | 9/2005 | Saunders et al. | 15/172 |
| 2005/0268416 | A1 * | 12/2005 | Sommers | 15/209.1 |
| 2007/0074362 | A1 * | 4/2007 | Michelson et al. | 15/209.1 |

* cited by examiner

*Primary Examiner* — Todd Manahan
*Assistant Examiner* — Jennifer Gill
(74) *Attorney, Agent, or Firm* — Robert C. Kain, Jr.

(57) ABSTRACT

The appliance includes a two-piece elongated handle with first and second handle pieces rotatably hinged via a locking stop which locks the handle upon full extension. A head piece rotatably mounted on the second handle piece with a coupling rotatably linking the head to the handle. The head piece is biased to a set position with a spring or torsion loadable stem such that upon rotation, the head returns to the set position. The front face of the planar plate has spaced hook ended pins upon which is releaseably mounted a removable cream bearing pad. The bearing pad includes a sponge pad for the lotion, soap or cream and a thin interfacing cloth attached to the rear of the bearing pad. The interfacing cloth has a multiplicity of loops which cooperate with the hooked pins for removable attachment of the bearing pad on the head piece.

16 Claims, 5 Drawing Sheets

LOTION, SOAP OR CREAM APPLICATOR OR APPLIANCE

The present invention relates to an applicator or an appliance used by a person to apply lotion, soap or cream to his or her back.

BACKGROUND OF THE INVENTION

For many years, users have had difficulties in applying sun screen lotion, tanning oil or cream, washing or cream soap, or skin cream onto their back. Further, it is difficult to extend one's arm and reach to the mid region and the lower portion of one's back. Other have developed cream or lotion applicators having elongated handles which are difficult to store and are not configured to collapse into a compact package. In addition, the application surface holding or containing the lotion, soap or cream, is either a single use or a limited time use cream bearing surface. Therefore, it is important to have a removable lotion bearing pad that can be removed, washed, cleaned, re-attached and reused.

In addition, the removability of the pad from the applicator head is an issue because the sponge on the cream bearing appliance head easily rips if the detachment mechanism is not easily releasable.

OBJECTS OF THE INVENTION

It is an object of the present invention to provide a lotion, soap or cream applicator which as a collapsable, two piece handle.

It is another object of the present invention to provide an applicator wherein the sponge can be easily removed from the head of the applicator or appliance for cleaning or replacement.

It is an additional object of the present invention to provide a two piece handle with a locking stop.

It is a further object of the present invention to have an appliance head that is partly rotatably mounted with respect to the elongated handle and which has a biasing mechanism, such as a spring or other element, which returns the head to a predetermined angular position. In this manner, the lotion bearing pad on the appliance head follows, in a cam-like manner, the curves of the back.

BRIEF DESCRIPTION OF THE DRAWINGS

Further objects and advantages of the present invention can be found in the detailed description of the preferred embodiments when taken in conjunction with the accompanying drawings in which.

SUMMARY OF THE INVENTION

The appliance, used to apply lotion, soap or cream to the back of a person includes a two-piece elongated handle with a first handle piece rotatably hinged to a second handle piece. These handle pieces are, in a preferred embodiment, slightly curved such that upon closure, they handle sections mate and form a compact structure. The handle segments are joined together with a hinge coupling permitting substantially 180 degree rotation of the first piece with respect to the second piece. The hinge coupling has a locking stop wherein, when the first and second pieces are fully extended, the locking stop substantially eliminates a collapsing closure of the elongated handle. The appliance also includes a head piece partially rotatably mounted at the end of the second handle piece. The head piece has a planar element with a front face and a rear face and a head body defined on the rear face of the planar element. The head body has a handle interfacing coupling rotatably linking the head piece to the handle piece or segment. The top of the second handle piece has a complementary interfacing coupling for rotatable attachment to the head piece.

A biasing means, such as a spring or torsion loadable stem, is included in the interfacing coupling for positioning the head piece planar element at a predetermined angular position with respect to the front face of the planar plate of the head piece. Upon rotation of the head piece with respect to the elongated handle, the planar element is biased to return to the predetermined angular position.

The front face of planar element has a plurality of hook ended pins protruding therefrom in a spaced apart relationship (not less than ⅛ inch apart). A removable lotion, soap or cream bearing pad is used and the bearing pad includes a sponge pad for the lotion, soap or cream on an exposed face of the bearing pad. Also, the bearing pad has a thin interfacing cloth attached to and covering a rear face of the sponge (the sponge thickness at least 10 times thicker than the cloth). The interfacing cloth has a multiplicity of loops which multiplicity of loops which exceeds the plurality of hook ended pins by at least 10 to 1, thereby proving a hook and loop removable attachment of the bearing pad onto the head piece.

DETAILED DESCRIPTION OF THE PREFERRED EMBODIMENTS

Figure 1:
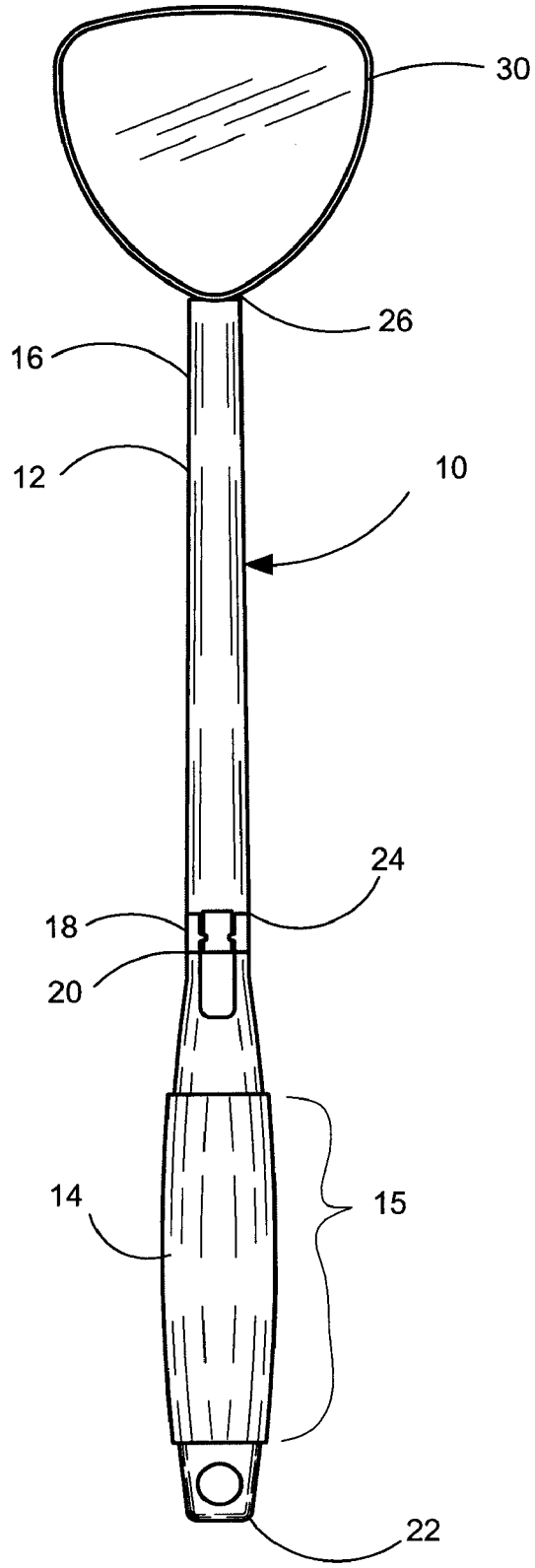
FIG. 1 diagrammatically illustrates a front view of the appliance or applicator wherein the two piece handle is in a fully extended position or mode.
Figure 2:
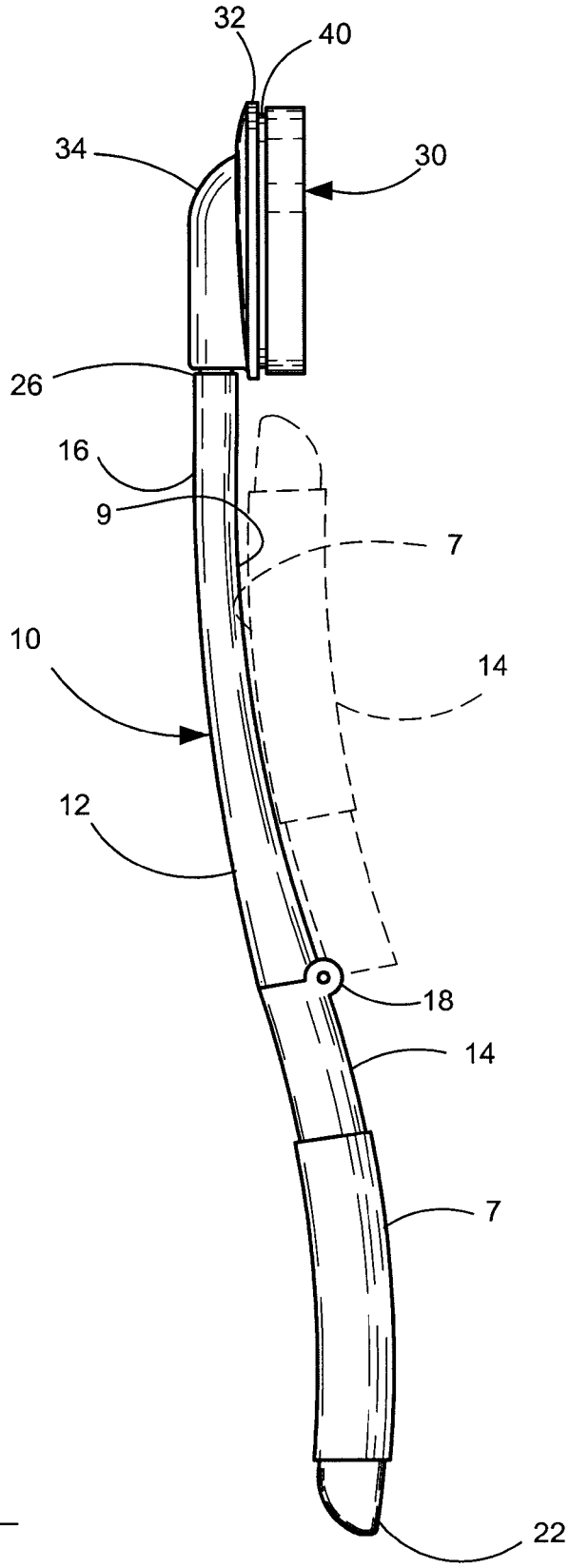
FIG. 2 diagrammatically illustrates a side view of the applicator and shows, in dashed lines, the compact, collapsed position of the first and second handle pieces.
Figure 3:
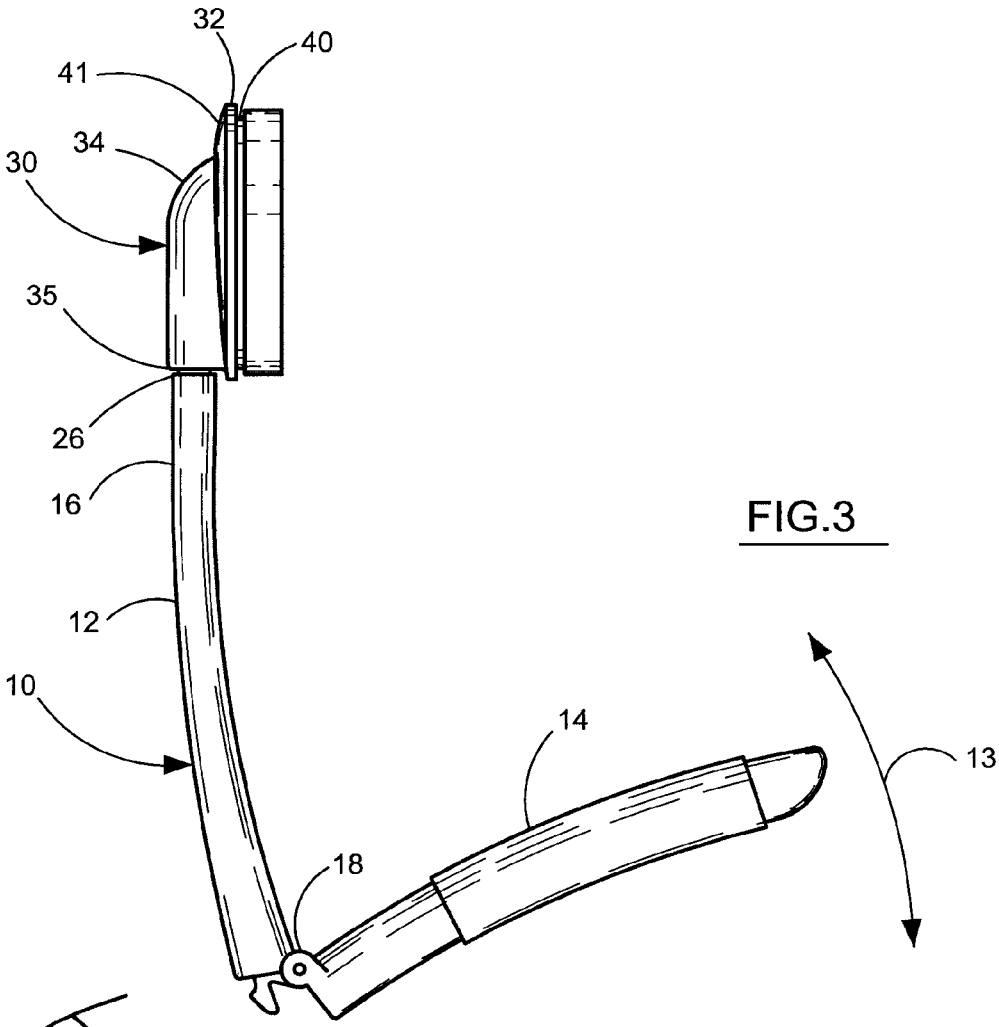
FIG. 3 diagrammatically shows the elongated handle in operation and the hinge coupling for the first and second pieces.

The present invention relates to an applicator or an appliance for applying lotion, soap or cream to the back of a person. Similar numerals designate similar items throughout the drawings. FIGS. 1, 2 and 3 are discussed concurrently herein.

Applicator or appliance 10 includes a two piece elongated handle 12 having a first piece 14 rotatably hinged to a second piece 16. See FIGS. 1, 2 and 3. Hinge system 18 is disposed at the distal end 20 of first handle piece 14. Second handle piece 16 includes a proximal end 24 with a complementary hinge coupling thereat and a distal head end 26 at the opposite end of handle piece 16. Head piece 30 is partially rotatably connected at distal head end 26 of second handle piece 16. In other words, the head has limited left-right rotation on the end of the handle. See FIG. 1. First handle piece 14 may include a special hand grip element 15 for the user.

As best shown in FIG. 2, head piece 30 includes a general planar plate element 32 in a head body 34. Planar plate 32 includes a front face 40 and a rear face 41. Head body 34 is defined on rear face 41 of planar element 30. Head body 34 has a proximal end region 35 with a handle interface coupling thereat.

FIG. 2 shows elongated handle 12 in a fully extended position or mode and shows first handle piece 14 in dashed lines when the applicator 10 is in a compact mode. In this collapsed compact position, with first handle segment 14 adjacent second handle segment 16, the inboard curve 9 on segment 16 matches and is complementary to the outboard curve 7 on first handle segment 14. In this manner, the first handle segment 14 closely matches and is adjacent and/or touching the second handle segment 16. Handle segment 14 has a slight or shallow depth convex forward facing curve (about ½ inch deep) and segment 16 has a matching shallow concave curve.

Figure 4:
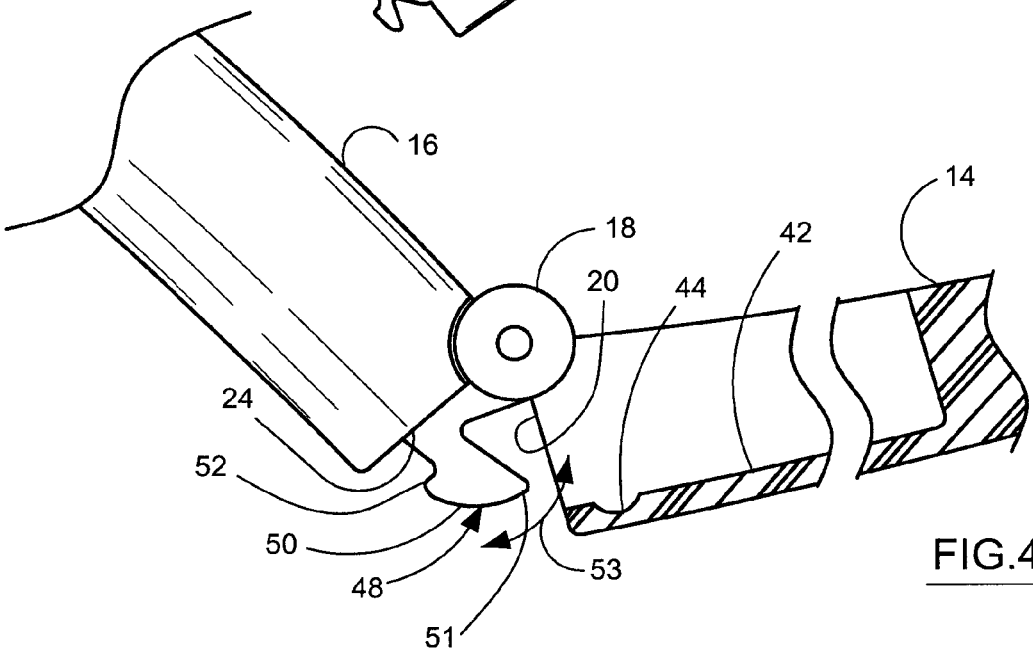
FIG. 4 diagrammatically illustrates a detail of the hinge coupling for the handle.

FIG. 4 shows a detail of the hinged coupling between first and second handle segments 14, 16.

The designations "proximal" and "distal," refer to items closer to or further away from terminal end 22 of the first handle segment 14.

Distal end 20 of handle segment 14 in the illustrated embodiment, includes an interior channel or cavity with a cam surface 42 having a latch detent 44 on the cam surface 42. Proximal end 24 of second handle piece 16 includes a tang 48 protruding axially from piece 16. Tang 48 has a curved initial contact interface surface 50 at a terminal tang end 51 and has a catch edge 52 at an inboard portion of the contact interface 50. In operation, the curved initial contact interface 50 cooperates and touches and is adjacent to cam surface 42. When the catch edge 52 is adjacent and falls within the concave or depressed latch detent 44, a locking stop is established between the first and second handle segments 14, 16. As is known by persons of ordinary skills in the art, the cam surface can be configured on handle segment 16 and the tang 48 can be configured on handle segment 14. Further, the catch and latch may include a simple depression detent 44 and a protrusion or dimple at a distal portion of curved initial contact interface 50. In other words, tang 48 could have a dimple or other catch that interfaces into latch 44. The bead and dimple cavity can be reversed on segments 14, 16. The locking stop is one of the several important features of the present invention because (a) the interface and stop action between distal end 20 and proximal end 24 prohibits further clockwise rotation beyond substantially 180 degrees rotation about hinge 18, and (b) the locking stop with tang 48 and detent 44 securely locks the first and second handle segments together. This enables the user to move the appliance loaded with soap, lotion or cream along his or her back without fear of a collapsing handle. In the absence of a sturdy locking stop, the handle may collapse onto itself. Of course, a protruding dimple can be replaced from one handle segment with a depressed detent and the other handle segment could carry the protruding dimple rather than the depressed detent. Another significant aspect of the present invention is the curved initial contact interface 50 on the tang. Due to the multiple times the user will open and close the appliance, tang 48 has to be durable and nominally flexible as shown by double headed arrow 53. The tang flexes upon each closure to achieve the snap-in locking effect with the latch-catch. As a result, tang must be fairly rigid and the curved initial contact interface permits the cam surface to easily move over and move tang 48 in a counter rotational manner as compared with the rotational direction of handle segment 14 shown by double headed arrow 13 in FIG. 3.

Figure 5:
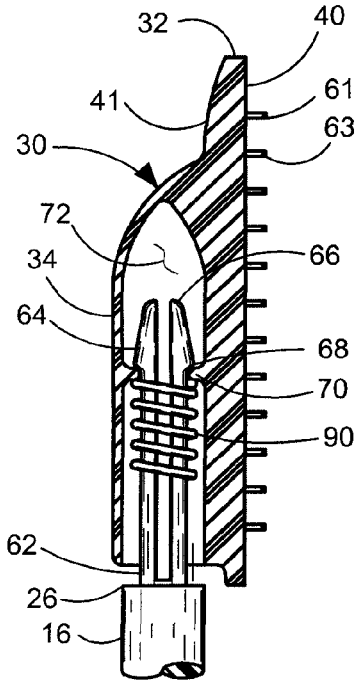
FIG. 5 diagrammatically illustrates a partial, cross-sectional view of the head piece and the rotatable interface coupling between the head piece and the elongated handle.
Figure 8:
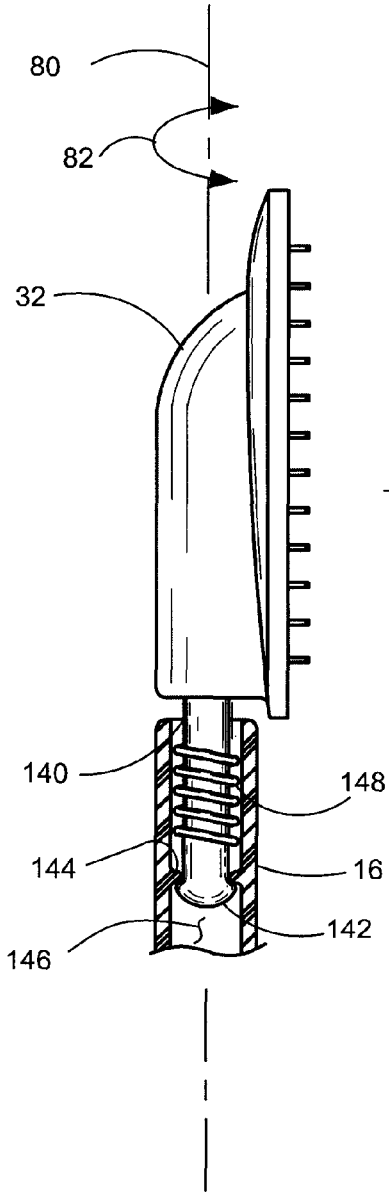
FIG. 8 diagrammatically illustrates another interface coupling between the head piece and the elongated handle.
Figure 6:
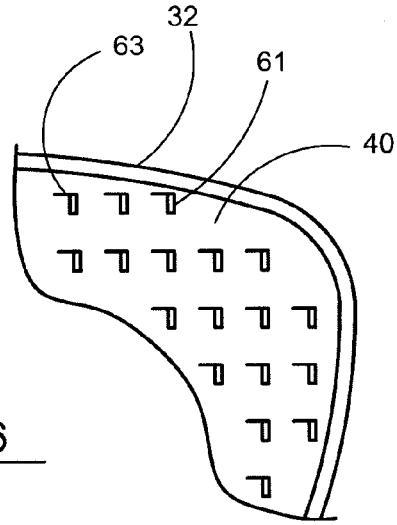
FIG. 6 diagrammatically illustrates a portion of the front face of the planar plate element of the head piece and the spacing of the hook end pins.

FIG. 5 diagrammatically shows details of the head piece 30. Head piece 30 is partly rotatably mounted on the distal head end 26 of second handle piece 16. Front face 40 of planar plate element 32 has a plurality of hook ended pins, two of which are identified as pins 61 and 63 in FIG. 5. Head body 34 is attached to or formed on rear face 41 of planar plate element 32. Head piece 32 is partially rotatably mounted on the second handle piece 16 by a handle interface coupling associated with piece 16 and a complementary interface end coupling which is disposed on the proximal edge segment of the head body 34. In one embodiment, this interface coupling includes a stem 62 having axially protruding stem elements 64, 66. Stem elements 64, 66 are spaced apart and move laterally with respect to each other. Stem elements 64, 66 protrude axially above main stem 62. Main stem 62 extends axially above distal end 26 of second handle element 16. A lock latch is established with these stem elements 64, 66 based on protrusions, one of which is protrusion 68 coacting with stop 70 formed in the cavity of the head body 34. Stem 62 and stem elements 64, 66 protrude into head body cavity 72. The interior surfaces of cavity 72 define stops and latch-catches. The elongated handle has an axial center line 80 shown in FIG. 8. Although the elongated handle in the fully extended position is slightly curved, second handle portion 16 generally has a singular axial center line. Head piece 32 partly rotates has shown by double headed arrow 82 in FIG. 8 about axial center line 80. To limit rotational movement of head piece 32 with respect to handle element 16, interior stop edges may be included as protruding into the interior of cavity 72 of head body 34. Stop edges limit the rotation of head 32 with respect to the handle. The circumferential stops impact stem pairs 64, 66 and limit the total left-right rotation of head 34 with respect to stationary handle 16 (left-right from front view FIG. 1). In addition, the head piece includes a biasing mechanism which, in this illustrated embodiment, is a spring 90. The spring returns head piece 34 to a predetermined angular position with respect to elongated handle 12. This predetermined position in the present embodiment is the position shown in side view FIG. 2 wherein planar plate 32 always faces forward towards the forward convex curve of handle piece 14. In a preferred embodiment, rotation of the head piece is limited to 45 degrees about axial center line 80. In another words, head piece can rotate approximately 22.5 degrees to the right shown in FIG. 1 and 22.5 degrees to the left shown in FIG. 1. In a similar manner to FIG. 5, FIG. 8 shows head piece 30 with body 34 having a downward stem 140 (a mirror to stem 62 in FIG. 5, without the stem elements 64, 66), a biasing spring 148, a lateral protrusion 142 (a mirror of protrusion 68 in FIG. 5) and laterally inboard protrusion 144 (see mirror element stop protrusion 70 in FIG. 5). In this manner, the biasing mechanism may be in handle 16 rather than head 30.

This partial rotation and biasing towards a singular angular position is another one of the several important features of the present invention. During the application of lotion, soap or cream, it is important that the head piece 30, slightly rotate in order to accommodate the curves in a person's back. However, when the person lifts the head piece away from his or her back and skin surface, the head piece should return to the angular predetermined position. Other predetermined positions, other than that shown in FIG. 2, may be selected by the appropriate mechanical positioning of circumferential stops.

Also, other biasing mechanisms, other than spring 90, may be utilized. For example, stem 62 may include a long extension subjected to torque twisting that is coupled to the distal end of cavity 72 of head body 34. If the attached head-handle stem is thin enough, the head piece 30 will partly rotate about the axial centerline 80. The head will return to the predetermined 90 degree position due to the release of torque force and the twisting return to the angular position by the elongated stem. Other biasing mechanisms such as elastic or spring loaded cam elements and cam followers may be utilized. The cam elements act as springs when the stem 62 is rotated in the interior cavity of the head body.

Another one of the several important features of the present invention is the releaseability of the bearing pad 92 from the front face 40 of the head piece plate 32.

Figure 7:
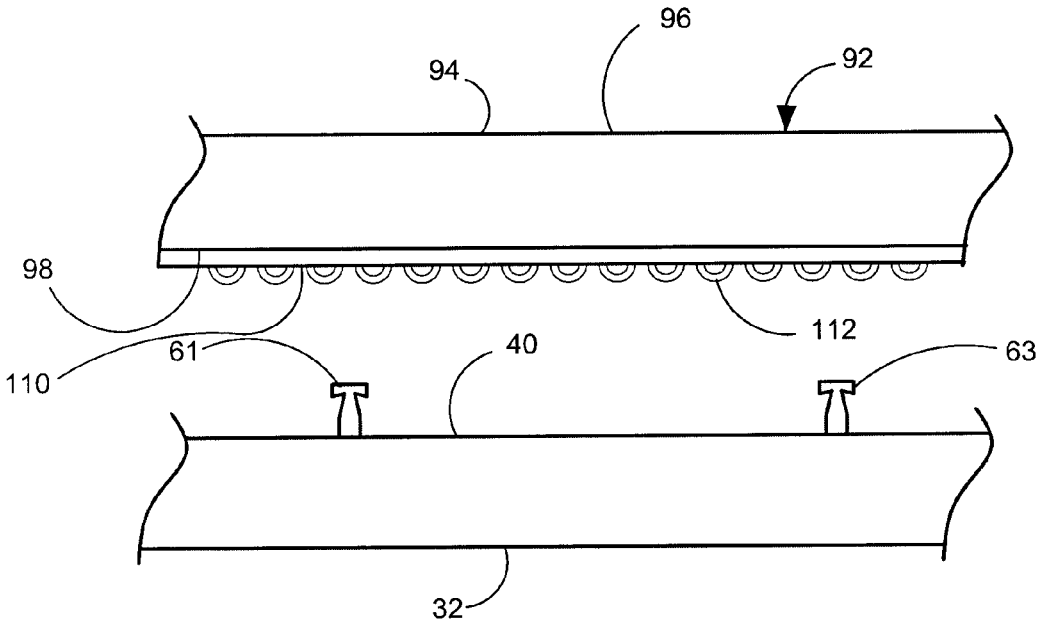
FIG. 7 diagrammatically shows a partial, cross-sectional view of the lotion, soap or cream bearing pad, the sponge head portion of the bearing pad, the thin interfacing cloth with a multiplicity of loops, and a side view of the front face of the planar plate element of the head piece with the spaced apart hook end pins.

FIG. 7 shows bearing pad 92 which has an exposed front face 94 of a sponge 96. The rear face 98 of sponge 96 has a thin interfacing cloth. The Table listed below shows dimensions and sizes for one embodiment of the present invention.

Dimension Table 12 rows of hook pins
maximum per row 17 pins
minimum per row 7 pins
typical width of plate 3.25 inches
typical height of plate 3.25 inches
pin spacing 6 pins per inch
pin spacing ¼ inch to ⅛ inch (nominally ⅛ inch)
pin height about ⅛ inch
pin shape: T-shape or mushroom cap or inverted L shape FIG. 7 shows that interfacing cloth 110 has a multiplicity of loops 112 which greatly exceed, on the order of 10 to 1, the plurality of hook end pins 61, 63 protruding from front face 40 of head body 32. Pins 61, 63 can be T shaped, inverted L shaped or mushroom cap shaped in order to define a hook end to catch one or more of loops 112 on thin interfacing cloth 110.

The releaseability of bearing pad 92 is important since sponge 96 becomes slippery with soap or lotion and the user has difficulty in lifting bearing pad 92 from planar, rigid plate 32. Also, the interface cloth after multiple uses may weaken and may improperly separate from the sponge if the bearing pad is not easily releaseable from the face plate. Hence, the relatively great spacing between hook ended pins 61, 63 and the multiplicity of loops 112 on the bearing pad 92 enhances releasability of pad 92 from plate 32. The releaseability enables the user to remove the bearing pad 92, wash it and either re-use the pad or replace it with a new bearing pad.

The claims appended hereto are meant to cover modifications and changes within the scope and spirit of the present invention. Certain features may be omitted in the working embodiments of the present invention and other features may be added to further enhance the operability of the lotion, soap or cream applicator.

What is claimed is:

1. An appliance for applying lotion, soap or cream on the back of a person comprising:

a two-piece elongated handle with a first piece rotatably hinged to a second piece, said first piece defining a handle segment and having a free, terminal end and a distal end with a hinge coupling thereat, said second piece having a proximal end with a complementary hinge coupling thereat and a distal head handle end;

said hinge coupling and complementary hinge coupling permitting substantially 180 degree rotation of said first piece with respect to said second piece and having a locking stop when said first and second pieces are in a fully extending position thereby substantially eliminating a collapsing closure of said elongated handle when fully extended;

a head piece partially rotatably mounted at said distal head handle end such that the head piece is prevented from making a complete rotation with respect to the handle, said head piece having a planar element with a front face and a rear face, said head piece having a head body defined on the rear face of said planar element and said head body having a handle interfacing coupling at a proximal end region of said head piece;

said distal head handle end having a complementary interfacing coupling for rotatable attachment to said head piece via said handle interfacing coupling at said head body;

biasing means operative on said handle interfacing coupling and said complementary handle interfacing coupling for positioning said head piece planar element at a predetermined angular position about an axial centerline substantially defined by said elongated handle when fully extended such that upon rotation of said head piece with respect to said elongated handle, said planar element is biased to return to said predetermined angular position;

the front face of planar element having a plurality of hook ended pins protruding therefrom, each pin spaced apart from other pins by a distance not exceeding one quarter inch;

a removable lotion, soap or cream bearing pad having a sponge pad for said lotion, soap or cream on an exposed face of said bearing pad and said bearing pad having a thin interfacing cloth attached to and covering a rear face of said sponge, said interfacing cloth having a multiplicity of loops which multiplicity of loops exceeds said plurality of hook ended pins by at least 10 to 1, thereby providing means for a hook and loop removable attachment of said bearing pad onto said head piece.

2. An appliance for applying lotion, soap or cream as claimed in claim 1 wherein said biasing means is a spring disposed in said head body.

3. An appliance for applying lotion, soap or cream as claimed in claim 1 wherein said locking stop includes a tang extending from one or the other of said distal first piece end and said proximal second piece end, said tang having a curved initial-contact interface at a terminal tang end and a catch edge inboard of said curved initial-contact interface on said tang;

a cam surface formed on the other of said distal first piece end and said proximal second piece end, said cam surface having a latch detent disposed inboard of said piece end, and cam surface first engaging said curved initial-contact interface of said tang and said latch detent coacting said catch edge to lock said first and second pieces together to form said elongated handle in said fully extended position.

4. An appliance for applying lotion, soap or cream as claimed in claim 1 wherein said interfacing coupling includes a stem protruding into a locking channel and wherein said biasing means is a spring disposed about said stem thereby permitting said head piece to rotate about said axial centerline of said elongated handle and forcing the return of said head piece to said predetermined angular position.

5. An appliance for applying lotion, soap or cream as claimed in claim 4 wherein said interfacing coupling includes a pair of opposing rotation stops limiting rotation to no more than 45 degrees about said axial centerline.

6. An appliance for applying lotion, soap or cream as claimed in claim 1 wherein said sponge is more than 10 times thicker than said interfacing cloth.

7. An appliance for applying lotion, soap or cream as claimed in claim 1 wherein said first handle piece is slightly convexly curved forward and said second handle piece is slightly concavely curved backward and said convex curve and said concave curve being complementary such that when said first and second handle pieces are in a closed, compact position adjacent each other, said first and second handle pieces lie in close proximity of each other due to said complementary curvatures.

8. An appliance for applying lotion, soap or cream as claimed in claim 1 wherein said hook ended pins are spaced apart no less then one-eighth inches apart.

9. An appliance for applying lotion, soap or cream as claimed in claim 8 wherein said hook ended pins are spaced over the entirety of said front face of said planar element.

10. An appliance for applying lotion, soap or cream as claimed in claim 2 wherein said locking stop includes a tang extending from one or the other of said distal first piece end and said proximal second piece end, said tang having a curved initial-contact interface at a terminal tang end and a catch edge inboard of said curved initial-contact interface on said tang;

a cam surface formed on the other of said distal first piece end and said proximal second piece end, said cam surface having a latch detent disposed inboard of said piece end, and cam surface first engaging said curved initial-contact interface of said tang and said latch detent coacting said catch edge to lock said first and second pieces together to form said elongated handle in said fully extended position.

11. An appliance for applying lotion, soap or cream as claimed in claim 10 wherein said interfacing coupling includes a stem protruding into a locking channel and wherein said biasing means is a spring disposed about said stem thereby permitting said head piece to rotate about said axial centerline of said elongated handle and forcing the return of said head piece to said predetermined angular position.

12. An appliance for applying lotion, soap or cream as claimed in claim 11 wherein said interfacing coupling includes a pair of opposing rotation stops limiting rotation to no more than 45 degrees about said axial centerline.

13. An appliance for applying lotion, soap or cream as claimed in claim 12 wherein said sponge is more than 10 times thicker than said interfacing cloth.

14. An appliance for applying lotion, soap or cream as claimed in claim 13 wherein said first handle piece is slightly convexly curved forward and said second handle piece is slightly concavely curved backward and said convex curve and said concave curve being complementary such that when said first and second handle pieces are in a closed, compact position adjacent each other, said first and second handle pieces lie in close proximity of each other due to said complementary curvatures.

15. An appliance for applying lotion, soap or cream as claimed in claim 14 wherein said hook ended pins are spaced apart no less then one-eighth inches apart.

16. An appliance for applying lotion, soap or cream as claimed in claim 15 wherein said hook ended pins are spaced over the entirety of said front face of said planar element.

* * * * *